US008827414B2

(12) United States Patent
Abe

(10) Patent No.: US 8,827,414 B2
(45) Date of Patent: Sep. 9, 2014

(54) IMAGE FORMING APPARATUS, DROPLET DISCHARGE DETECTING METHOD IN THE IMAGE FORMING APPARATUS, AND COMPUTER PROGRAM PRODUCT

(75) Inventor: Kimito Abe, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 217 days.

(21) Appl. No.: 13/410,852

(22) Filed: Mar. 2, 2012

(65) Prior Publication Data

US 2012/0223997 A1 Sep. 6, 2012

(30) Foreign Application Priority Data

Mar. 3, 2011 (JP) ..... 2011-046484

(51) Int. Cl.
*B41J 29/393* (2006.01)

(52) U.S. Cl.
USPC ..... 347/19

(58) Field of Classification Search
USPC ..... 347/19
See application file for complete search history.

(56) References Cited

U.S. PATENT DOCUMENTS

| | | | | |
|---|---|---|---|---|
| 6,517,183 | B2 * | 2/2003 | Bruch et al. | 347/19 |
| 2002/0018090 | A1 * | 2/2002 | Takazawa et al. | 347/19 |
| 2002/0041304 | A1 * | 4/2002 | Kobayashi et al. | 347/23 |
| 2011/0205283 | A1 * | 8/2011 | Ito et al. | 347/19 |

FOREIGN PATENT DOCUMENTS

| | | | | |
|---|---|---|---|---|
| JP | 2006-110964 | A | | 4/2006 |
| JP | 2007-144900 | A | * | 6/2007 |
| JP | 2007144900 | A | | 6/2007 |
| JP | 2007-296670 | A | | 11/2007 |
| JP | 2009-078539 | A | | 4/2009 |

OTHER PUBLICATIONS

English Machine Translation JP 2007-144900A.*
Abstract of JP 2009-078539 published Apr. 16, 2009.
Abstract of JP 2007-144900 published Jun. 14, 2007.
Abstract of JP 2006-110964 published Apr. 27, 2006.
Abstract of JP 2007-296670 published Nov. 15, 2007.

* cited by examiner

*Primary Examiner* — Julian Huffman
*Assistant Examiner* — Sharon A Polk
(74) *Attorney, Agent, or Firm* — Harness, Dickey & Pierce, P.L.C.

(57) ABSTRACT

An image forming apparatus includes: a droplet discharging head that includes nozzles; a light emitting unit that irradiates laser light emitted in a direction intersecting a discharging direction of a droplet discharged from each of the nozzles; a light-receiving unit that receives scattered light when the droplet is irradiated by the laser light and outputs a detection signal; and a droplet discharge detecting unit that detects a droplet discharging state of each of the nozzles based on the detection signal from the light-receiving unit. The light emitting unit emits the laser light such that intensity of the laser light gradually increases or decreases as the laser light travels farther, and the droplet discharge detecting unit selects nozzles so as to cause a variation in the detection signal depending on a droplet discharging state, and detects the droplet discharging state of the detection target nozzles based on the scattered light.

13 Claims, 16 Drawing Sheets

IMAGE FORMING APPARATUS, DROPLET DISCHARGE DETECTING METHOD IN THE IMAGE FORMING APPARATUS, AND COMPUTER PROGRAM PRODUCT

CROSS-REFERENCE TO RELATED APPLICATIONS

The present application claims priority to and incorporates by reference the entire contents of Japanese Patent Application No. 2011-046484 filed in Japan on Mar. 3, 2011.

BACKGROUND OF THE INVENTION

1. Field of the Invention

The present invention relates to an image forming apparatus, a droplet discharge detecting method in the image forming apparatus, and a computer program product.

2. Description of the Related Art

Generally, in inkjet recording devices, especially in a recording device provided with a head (linehead) as long as the width of paper, the head is not moved during printing and instead, a sheet of paper is conveyed directly beneath the head where ink is discharged onto the sheet so as to form an image thereon. In a printing method described above, when a nozzle is clogged and fails to discharge the ink, an image formation cannot be properly performed.

Thus, there is a need to dissolve clogging in a nozzle and hence, detection of a non-discharging state of a nozzle is performed first. Conventionally, there is a technology for detecting a nozzle in the non-discharging state (defect) by using a sensor formed by a pair of a laser diode (LD) and a photo diode (PD). Nozzles arranged in a row are caused to sequentially discharge ink droplets, and direct light or scattered light that appears when laser light emitted from the LD intersects the ink droplet is detected by the PD, thereby to detect a nozzle in the non-discharging state (defect).

Recent production of a high density and highly integrated head causes the time for detecting a nozzle defect to be increased significantly. In view of such a situation, Japanese Patent Application Laid-open No. 2006-110964, for example, discloses a technology that adopts a method for detecting a flying droplet either by tilting the direction of an optical axis of the detection light against the arrangement direction of the droplet discharging outlets and by performing control on the discharging timing of a droplet, or by performing control on a plurality of the nozzles in discharging droplets with shifted timing so that a plurality of droplets are kept in a state in which the droplets do not overlap each other within the cross section of the detection light. Accordingly, a plurality of droplets discharged from different droplet discharging outlets can be simultaneously detected, thereby achieving shortening of the detection time.

However, the conventional method for detecting a nozzle defect by having each nozzle discharge an ink droplet one by one has the problem in that it takes too much time in detecting the nozzle defect in a situation where a high density and highly integrated head is produced. The technology disclosed in Japanese Patent Application Laid-open No. 2006-110964 is capable of determining the number of ink droplets having been discharged simultaneously from a plurality of nozzles, but is incapable of determining which nozzle does have a defect.

Thus, there is a need to provide an image forming apparatus, a droplet discharge detecting method in the image forming apparatus, and a computer program product capable of decreasing time needed for detecting a nozzle defect and further capable of identifying which nozzle has a defect.

SUMMARY OF THE INVENTION

It is an object of the present invention to at least partially solve the problems in the conventional technology.

An image forming apparatus includes: a droplet discharging head that includes a plurality of nozzles; a light emitting unit that irradiates laser light emitted from a light-emitting element in a direction intersecting a discharging direction of a droplet discharged from each of the nozzles of the droplet discharging head; a light-receiving unit that receives scattered light that is scattered when the droplet that has been discharged is irradiated by the laser light and outputs a detection signal corresponding to an amount of the scattered light; and a droplet discharge detecting unit that detects a droplet discharging state of each of the nozzles based on the detection signal output from the light-receiving unit. The light emitting unit emits the laser light such that intensity of the laser light gradually increases or decreases as the laser light travels farther from the light emitting unit, and the droplet discharge detecting unit selects, from the droplet discharging head, a plurality of nozzles located at different distances from the light emitting unit so as to cause a variation in the detection signal depending on a droplet discharging state, and detects the droplet discharging state of each of the detection target nozzles based on the scattered light scattered by irradiation of droplets that are simultaneously discharged from the detection target nozzles.

A droplet discharge detecting method is implemented in an image forming apparatus that includes a droplet discharging head. The droplet discharging head includes a plurality of nozzles, a light emitting unit that irradiates laser light emitted from a light-emitting element in a direction intersecting a discharging direction of a droplet discharged from each of the nozzles of the droplet discharging head, a light-receiving unit that receives scattered light that is scattered when the droplet that has been discharged is irradiated by the laser light and outputs a detection signal corresponding to an amount of the scattered light, and a droplet discharge detecting unit that detects a droplet discharging state of each of the nozzles based on the detection signal output from the light-receiving unit. The method includes: emitting, by the light emitting unit, the laser light such that intensity of the laser light gradually increases or decreases as the laser light travels farther from the light-emitting section; selecting, by the droplet discharge detecting unit, from the droplet discharging head, a plurality of nozzles located at different distances from the light emitting unit so as to cause a variation in the detection signal depending on the droplet discharging state; and detecting, by the droplet discharge detecting unit, the droplet discharging state of each of the detection target nozzles based on the scattered light scattered by irradiation of droplets that are simultaneously discharged from the detection target nozzles.

A computer program product includes a non-transitory computer-usable medium having a computer-readable program code embodied in the medium causing a computer to instruct an image forming apparatus that includes: a droplet discharging head that includes a plurality of nozzles; a light emitting unit that irradiates laser light emitted from a light-emitting element in a direction intersecting a discharging direction of a droplet discharged from each of the nozzles of the droplet discharging head; a light-receiving unit that receives scattered light that is scattered when the droplet that has been discharged is irradiated by the laser light and outputs a detection signal corresponding to an amount of the scattered light; and a droplet discharge detecting unit that detects a droplet discharging state of each of the nozzles based on the detection signal output from the light-receiving unit to function as: the light emitting unit that emits the laser light such that intensity of the laser light gradually increases or decreases as the laser light travels farther from the light emitting unit, and the droplet discharge detecting unit that selects, from the droplet discharging head, a plurality of nozzles located at different distances from the light emitting unit so as to cause a variation in the detection signal depending on a droplet discharging state, and that detects the droplet discharging state of each of the detection target nozzles based on the scattered light scattered by irradiation of droplets that are simultaneously discharged from the detection target nozzles.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments are described in detail below with reference to the attached drawings.

Figure 1:
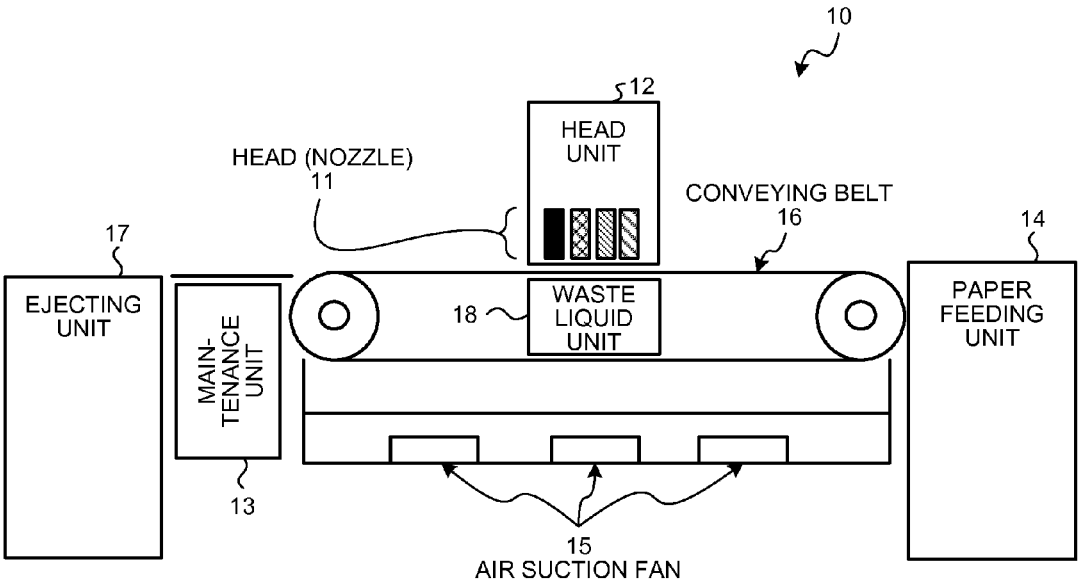
FIG. 1 is a diagram illustrating an overall schematic configuration of an inkjet recording device that includes a printing head provided along a line.

First, a schematic configuration of an inkjet recording device that includes a printing head provided along a line will be described with reference to FIG. 1. FIG. 1 is a diagram of an overall schematic configuration of an inkjet recording device having a printing head provided along a line.

An inkjet recording device 10 illustrated in FIG. 1 is also called a line printer. When printing, a plurality of print heads 11 (hereinafter referred to as heads 11) having a length that matches a printing width is fixed along a line to print on a recording sheet that has been conveyed thereto. In each of the heads 11, a plurality of nozzles for discharging ink is provided. The heads 11 mounted on a print head unit 12 (hereinafter referred to as a head unit 12) are usually provided in a staggered arrangement; however, a single unit as a linehead may be mounted instead thereon.

On the head unit 12, the heads 11 discharging ink of respective colors of yellow (Y), cyan (C), magenta (M), and black (Bk) are usually provided in a sheet conveying direction, and are mounted with an ink discharging direction facing downward. In the mean time, the number of ink colors and the arrangement order of the colors in the heads 11 with respect to the sheet conveying direction are not limited thereto.

The head unit 12 includes sub tanks (not illustrated) mounted thereon for supplying respective colors of ink to the heads 11. Each of the sub tanks for the corresponding color includes an ink supply tube through which ink is replenished from an ink cartridge (ink tank) mounted on a cartridge holder using a supply pump unit provided in the cartridge holder for transporting the ink in the ink cartridge (ink tank) thereto.

The head unit 12 of the inkjet recording device 10 usually stays in a standby mode with a cap placed thereon in a maintenance unit 13 for preventing ink in nozzle openings of the heads 11 from drying. When a user causes the inkjet recording device 10 to start printing, the head unit 12 removes the cap placed in the maintenance unit 13 and moves to the home position to start printing. The printing is usually performed at the home position at which the head unit 12 is kept fixed during printing. When the printing is finished and if the head unit 12 is to be capped, the head unit 12 moves to the maintenance unit 13 as a standby mode and the cap is placed thereon. When no printing is scheduled for a long time or the apparatus is to be turned off, the nozzle openings of the heads 11 are to be capped in the maintenance unit 13.

On a paper feeding unit 14 illustrated in FIG. 1, a paper feed tray for setting a sheet of paper is mounted. From the paper feed tray, the sheet of papers are separated and fed one by one. The paper feed tray is configured to adapt to an arbitrary paper size, and to detect the sheet of paper being set with a sensor so as to determine the size and an orientation (portrait or landscape) of the sheet. The sensor also detects when the paper feed tray is empty or an error in feeding the paper. During continuous printing, the gap between the successive sheets can be changed, and can be adjusted from time to time depending on the size or the conveying speed (printing speed) of the sheet.

After being fed, sheets of paper are conveyed one by one while being suctioned onto a conveying belt 16 for suction due to the negative pressure generated by an air suction fan 15. When the sheet passes by the head unit 12, each of the heads 11 discharges ink of the corresponding color onto the sheet so as to print letters or images thereon. The printed sheet is conveyed to an ejecting unit 17 and stacked on a paper discharge tray.

Although not illustrated in FIG. 1, a waste liquid unit 18 is provided in a predetermined position beneath the head unit 12 for storing therein waste ink produced by discharging ink in the absence of a recording sheet. The waste liquid unit usually includes a sensor that detects when the unit is full, and the user discards the waste liquid.

Figure 2:
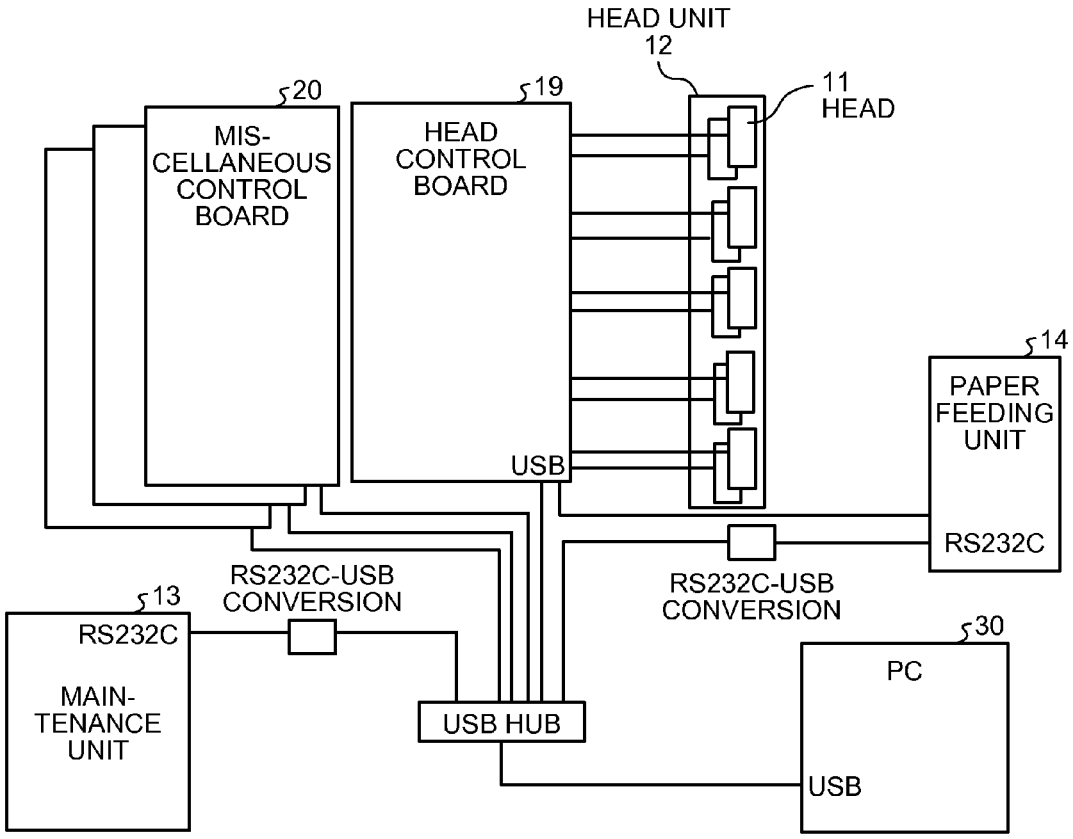
FIG. 2 is a diagram illustrating a configuration of an electric system included in the inkjet recording device according to present embodiments.

Next, a configuration of an electric system included in the inkjet recording device 10 of the present embodiment will be described with reference to FIG. 2. FIG. 2 is a diagram illustrating the configuration of the electric system of the inkjet recording device 10 according to the present embodiment.

The inkjet recording device 10 illustrated in FIG. 2 mainly includes the head unit 12 that controls the heads 11, the paper feeding unit 14 that feeds a sheet of paper from the paper feed tray and conveys the sheet, the maintenance unit 13 that performs maintenance and the like of the heads 11, a head control board 19 that controls the head unit 12, and a miscellaneous control board 20 that control various units.

The head control board 19 performs controls on each of the nozzles in the heads 11 based on print data from a PC 30 when and how much ink is to be discharge as ink droplets. The head control board 19 also controls discharge detection as described later. The head control board 19 and the miscellaneous control board 20 are control units equipped with a central processing unit (CPU) and a memory unit that includes a nonvolatile memory such as a flash memory or a volatile memory such as a dynamics random access memory (DRAM). A memory of the head control board 19 stores therein a control program to control the head unit 12 and a computer program to control a discharge detection unit as described later, for example.

Each unit is connected to the PC 30 that is an information processing device via a USB connection, through which data and commands are exchanged between the PC 30 and the each unit. In the inkjet recording device 10, although the paper feeding unit 14 and the maintenance unit 13 communicate with each other via RS232C, communication via RS232C is converted to communication through the USB connection for a standardization purpose. The conversion is done using a commercial conversion cable. By virtue of this, the PC 30 is capable of communicating with all the units via the USB connection, thereby enabling the PC 30 to recognize all the connected units as different USB devices for communication and control using the identification numbers.

The head unit 12 is configured such that each of the heads 11 is connected to and controlled by the head control board 19 via the USB connection and is further connected to the PC 30 via the USB HUB in an assembled manner. FIG. 2 illustrates that the single head control board 19 controls ten heads 11 provided along a line; however, depending on a print size or the like, the number of the heads 11 that the single head control board 19 can control is not limited to ten.

With the configuration described above, when the configuration of the heads 11 is to be changed, it is sufficient to connect a head control board 19 that is adaptable to the desired configuration via the USB connection thereto. When viewed from the PC 30 side, the head control board 19 that is newly connected is recognized as a USB device and hence can be used similarly as before.

In the present embodiment, a predetermined discrete signal is transmitted from the paper feeding unit 14 to the head control board 19 via parallel connection. Therefore, when a new head control board is to be added to the head control board 19, the newly added head control board is to be connected to the configuration in a parallel manner for receiving the discrete signal from the paper feeding unit 14.

Next, a discharge detecting unit of the inkjet recording device according to the present embodiment is described with reference to FIGS. 3 to 5.

Figure 3:
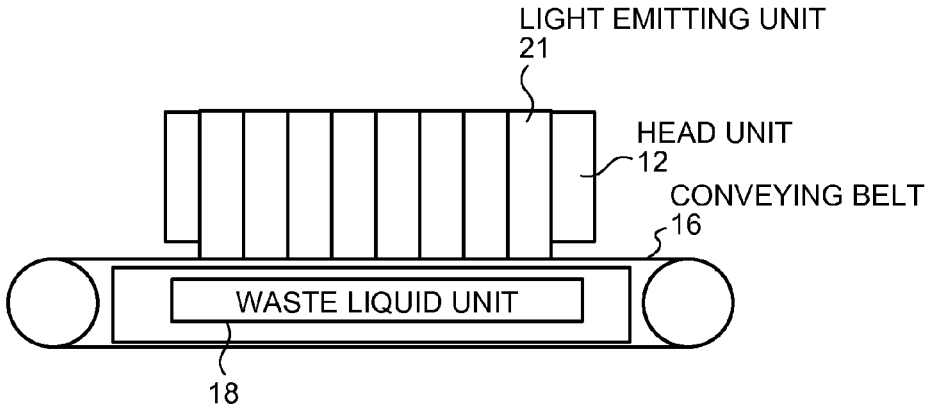
FIG. 3 is a schematic diagram illustrating a printing unit (overall configuration), in the inkjet recording device according to the present embodiments, viewed from a side of the printing unit that includes a discharge detecting unit located at a predetermined printing position of the inkjet recording device.

FIG. 3 is a schematic diagram illustrating a printing unit (overall configuration) of the inkjet recording device according to the present embodiment viewed from a side of the printing unit that includes a discharge detecting unit located in at a predetermined printing position of the inkjet recording device.

In the printing unit illustrated in FIG. 3, a discharge detecting unit is provided for each row of the heads. In FIG. 3, two discharge detecting units for each color, and eight discharge detecting units in total, are mounted on the printing units for detecting discharge of ink from nozzles of all the heads 11 thereby detecting a nozzle defect.

On both ends of each of the printing units, a light emitting unit 21 and a light-receiving unit (reference numeral 22 in FIG. 4) are mounted to form a discharge detecting unit for detecting discharge of ink from the corresponding printing unit. At a print position, a gap formed between the heads 11 and the conveying belt 16 is usually set to be about 1 mm. Discharge detection is performed in between the gap, and if it is safe to perform discharge detection immediately before printing, the conveying belt 16 is driven to convey the sheet of paper for printing. If discharge detection performed immediately before printing has detected a nozzle defect and the like, then the printing unit is moved to the maintenance position to perform a recovery operation on the particular head 11 or the nozzle in which the defect has been detected.

Figure 4:
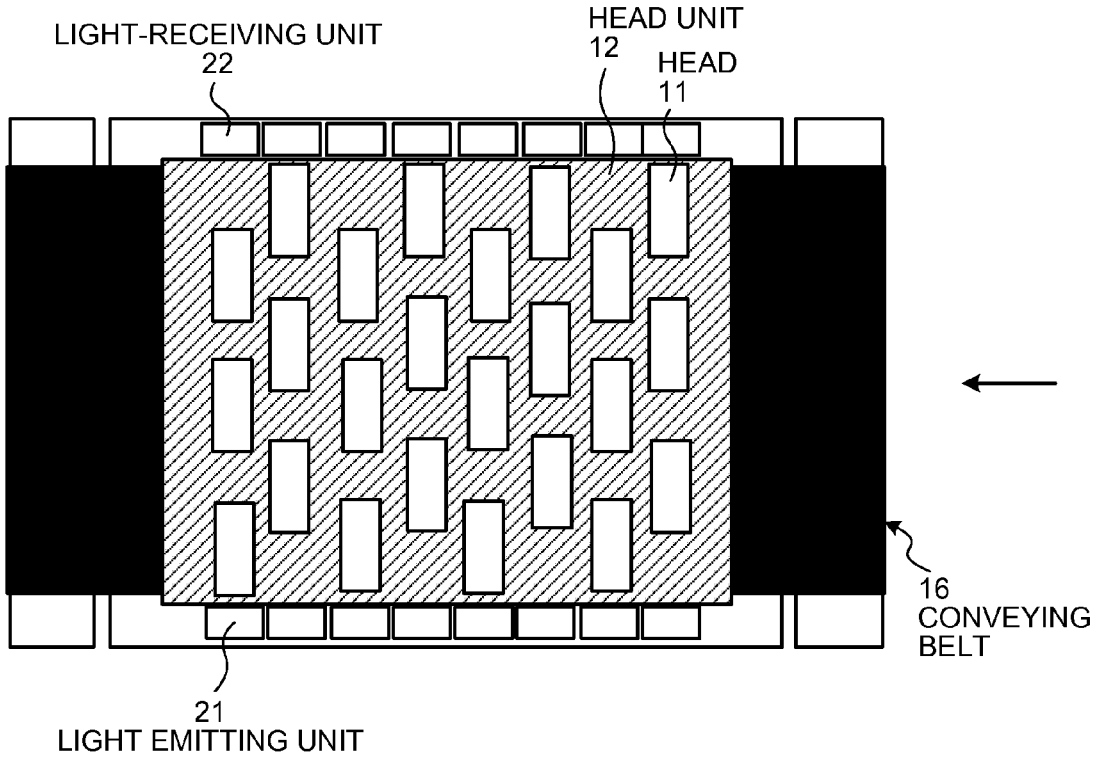
FIG. 4 is a schematic diagram illustrating the printing unit (overall configuration) of the inkjet recording device according to the present embodiments, viewed from the top of the printing unit that includes the discharge detecting unit in a predetermined printing position of the inkjet recording device.

FIG. 4 is a schematic diagram of the printing unit (overall) of the inkjet recording device according to the present embodiment illustrating the printing unit that includes the discharge detecting unit that is at a predetermined printing position of the inkjet recording device viewed from above.

On both ends of the printing unit illustrated in FIG. 4, the light emitting unit 21 and the light-receiving unit 22 for detecting discharge are mounted. The heads 11 are provided in a staggered arrangement on the printing unit, as illustrated in the drawing, and the discharge detecting unit is provided for each row of the heads 11.

The conveying belt 16 used in this embodiment includes holes for suctioning and conveying sheets of paper. The holes are usually arranged evenly, and in the present embodiment, detection of a nozzle defect is performed by controlling ink droplet discharge for discharge detection in synchronization with the movement of the holes of the conveying belt 16.

In the mean time, although not illustrated in the drawing, the maintenance position (a predetermined position on the maintenance unit 13) is a location where a recovery operation such as cleaning of the heads 11 is performed, and as described above, the maintenance unit 13 includes the cap that protects the heads 11 from drying or the like. The heads 11, when printing is not performed, are covered with the cap.

Figure 5:
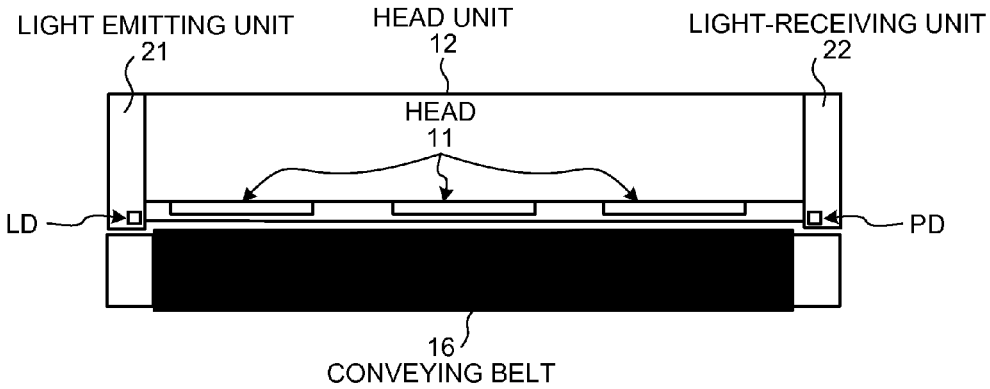
FIG. 5 is a schematic diagram illustrating the printing unit as a whole of the inkjet recording device according to the present embodiments viewed from the conveying direction of the printing unit that includes the discharge detecting unit in a predetermined printing position of the inkjet recording device.

FIG. 5 is a schematic diagram of the printing unit as a whole of the inkjet recording device according to the present embodiment viewed from a conveying direction of the printing unit that includes the discharge detecting unit in a predetermined printing position of the inkjet recording device. FIG. 5 illustrates a discharge detection state of the printing unit at a predetermined printing position.

On both ends of the printing unit, the light emitting unit 21 and the light-receiving unit 22 for detecting discharge are mounted. When the light emitting unit 21 and the light-receiving unit 22 are mounted on the printing unit, precise control on the adjustment of an optical axis is required, and a special jig or the like is usually used for the mounting. Laser light emitted from the LD of the light emitting unit 21 passes through the gap formed between the heads 11 and the conveying belt 16. Therefore, the laser light is emitted in the direction to intersect the direction of ink droplets discharged from each of the nozzles in the heads 11. The laser light irradiates the ink droplets discharged from the heads 11 to be scattered, and the scattered light is received by the PD of the light-receiving unit 22. In the present embodiment, an indirect method for observing indirect light (scattered light) generated by the reflection of the laser light by the ink droplet is used for detecting discharge. Therefore, the PD is provided in a position deviated from the optical axis of the laser light. The output voltage level of the PD on the light-receiving side increases when the PD detects a droplet, and this increase enables to detect discharge of the droplet. The output voltage level of the PD varies depending on the deviated position or the distance of the PD from the optical axis.

The droplet discharge detection in the inkjet recording device of the present embodiment will be described in detail below.

Figure 6A:
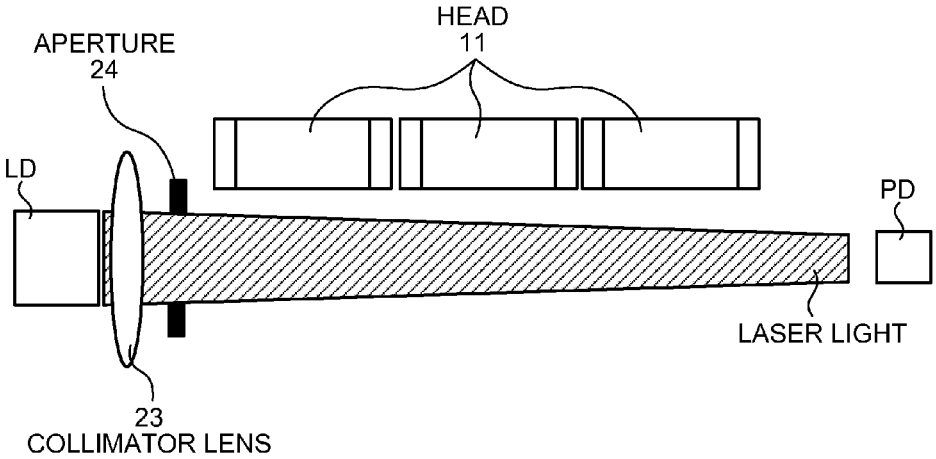
FIG. 6A is a side view of a droplet discharge detecting mechanism provided in the inkjet recording device according to a first embodiment.
Figure 6B:
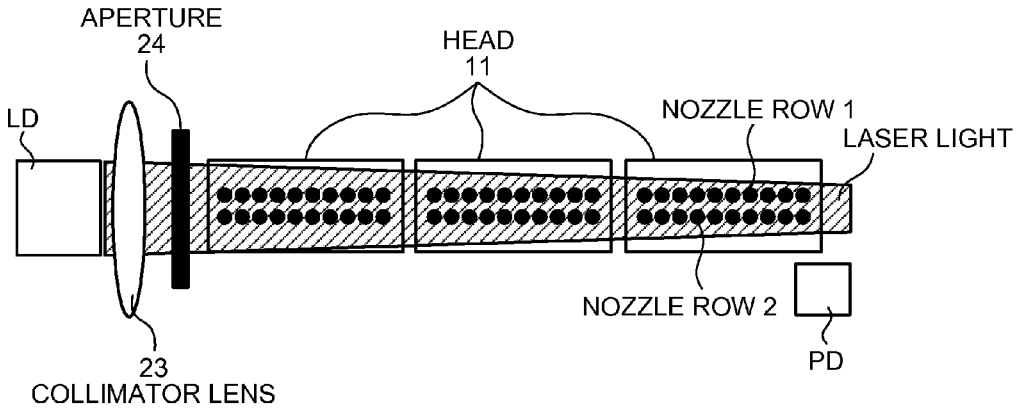
FIG. 6B is a plan view of the droplet discharge detecting mechanism viewed from the nozzle side.

FIG. 6A is a side view and FIG. 6B is a plan view (viewed from the nozzle side) of a droplet discharge detecting mechanism provided in the inkjet recording device.

The droplet discharge detecting mechanism illustrated in FIGS. 6A and 6B irradiates ink droplets discharged from the nozzles of the heads 11 with laser light emitted by the LD of the light emitting unit 21 such that the laser light intersects the ink droplets; causes the PD of the light-receiving unit 22 to receive scattered light that is generated by the irradiation of the discharged ink droplets with the laser light; and detects discharge of the ink droplets based on the output voltage level that is output by the PD thereby detecting a droplet discharging state.

The light emitting unit 21 includes the LD, a collimator lens 23, and an aperture 24. The laser light emitted by the LD passes through the collimator lens 23 and the aperture 24 for irradiation. The laser light used for the irradiation has a focal point that is positioned outside a discharge region. Therefore, the diameter of the laser light decreases as the laser light travels farther from the light emitting unit 21 in the droplet discharge region, and the intensity of the laser light increases with the decrease in the diameter of the laser light. In the present embodiment, the diameter of the laser light is set to decrease with an increase in the traveling distance of the laser light from the light emitting unit 21; however, the diameter of the laser light may be increased with an increase in the traveling distance from the light emitting unit 21. In this case, the intensity of the laser light decreases with an increase in the diameter of the laser light. In both cases, it is possible to detect the droplet discharging state as described below.

The light-receiving unit 22 includes the PD; receives the scattered light due to the irradiation of the discharged ink droplets with the laser light; and detects discharge of the ink droplets. Because the PD is caused to receive the scattered light, the light-receiving unit 22 is provided such that the PD is deviated from the optical axis of the laser light in order to prevent the laser light from being directly incident on the PD. When the diameter of the laser light decreases with an increase in the traveling distance of the laser light from the light emitting unit 21 in the droplet discharge region, the level of a detection signal due to the detection of the scattered light by the PD increases with an increase in a distance between a detection target nozzle and the light emitting unit 21. Conversely, when the diameter of the laser light increases with an increase in the traveling distance, the level of the detection signal by the PD decreases with an increase in the distance between a detection target nozzle and the light emitting unit 21.

As illustrated in FIG. 6B, each of the heads 11 includes two nozzle rows, i.e., a nozzle row 1 and a nozzle row 2. The diameter of the laser light emitted by the light emitting unit 21 is larger than the width of spacing between the nozzle rows, and the laser light irradiates all of ink droplets discharged from the nozzle row 1 and the nozzle row 2.

First Embodiment

A first embodiment of a droplet discharge detecting method will be described below with reference to FIGS. 7A to 12.

Figure 7A:
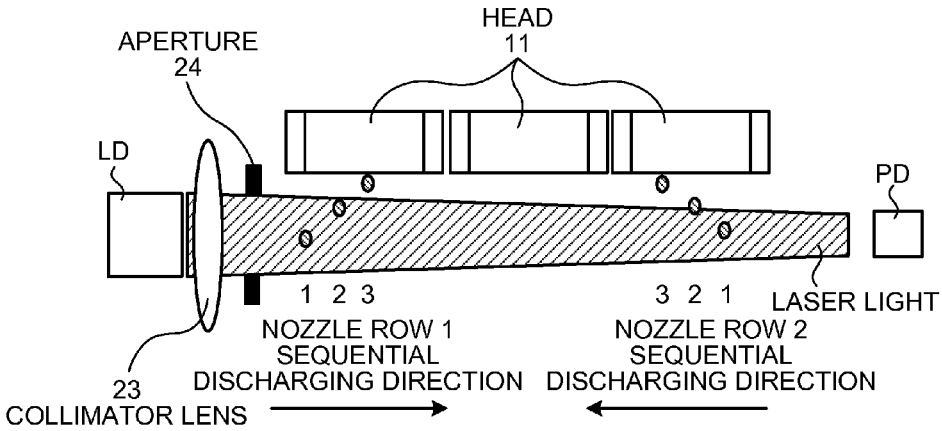
FIGS. 7A to 7C are diagrams illustrating a droplet discharging method and droplet discharge detection in the first embodiment.
Figure 7B:
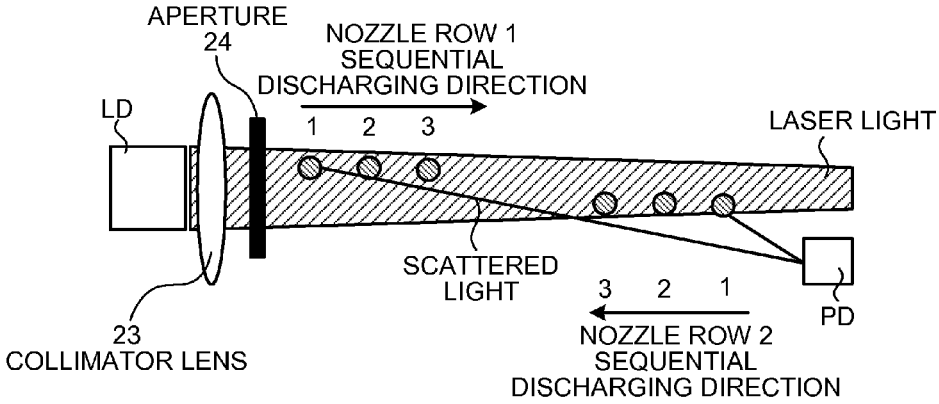
Figure 7C:
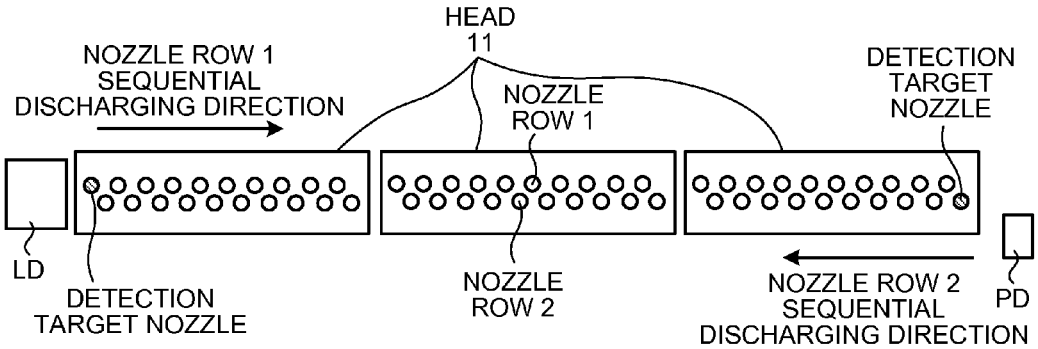

FIGS. 7A to 7C are diagrams illustrating a droplet discharging method and droplet discharge detection in the first embodiment. As illustrated in FIGS. 7A and 7C, in the droplet discharge detection, ink droplets are discharged in order from the endmost nozzle on the LD side toward the PD side in the nozzle row 1 while ink droplets are discharged in order from the endmost nozzle on the PD side toward the LD side in the nozzle row 2. The sequential discharge operations in the nozzle row 1 and the nozzle row 2 are performed synchronously; therefore, two nozzles simultaneously discharge ink droplets.

An LD-side nozzle in the nozzle row 1 and a PD-side nozzle in the nozzle row 2 are configured to simultaneously discharge ink droplets; therefore, when the both nozzles discharge ink droplets, the two discharged ink droplets simultaneously pass through the axis of the laser light. Because the diameter of the laser light is larger than the width of the spacing between the nozzle rows and the ink droplets are simultaneously discharged from the different nozzle rows, i.e., the nozzle row 1 and the nozzle row 2, the laser light irradiates the two discharged ink droplets simultaneously and is scattered. Therefore, it becomes possible to simultaneously detect discharge from the nozzle row 1 and the nozzle row 2 (see FIG. 7B).

Figure 8A:
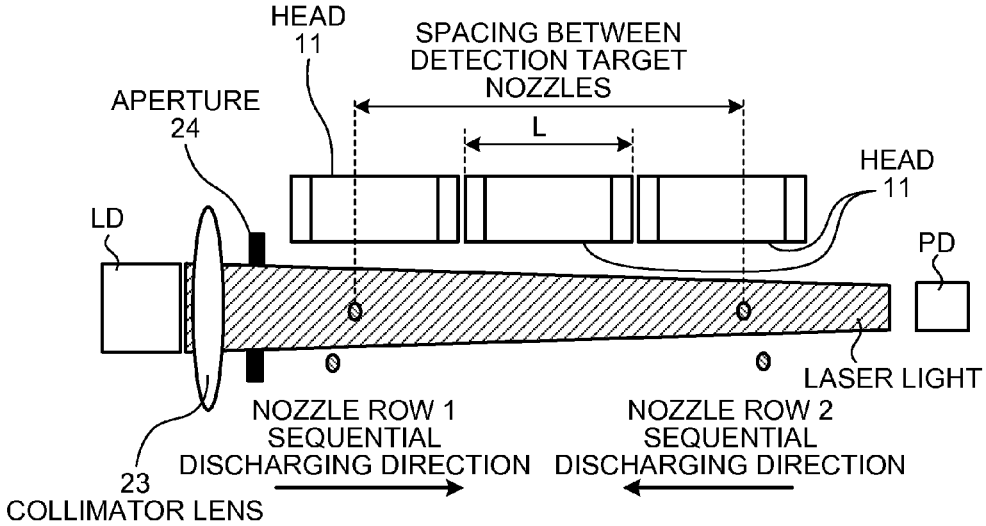
FIGS. 8A and 8B are diagrams illustrating an ink droplet discharging state when a distance between detection target nozzles is long in the first embodiment.
Figure 8B:
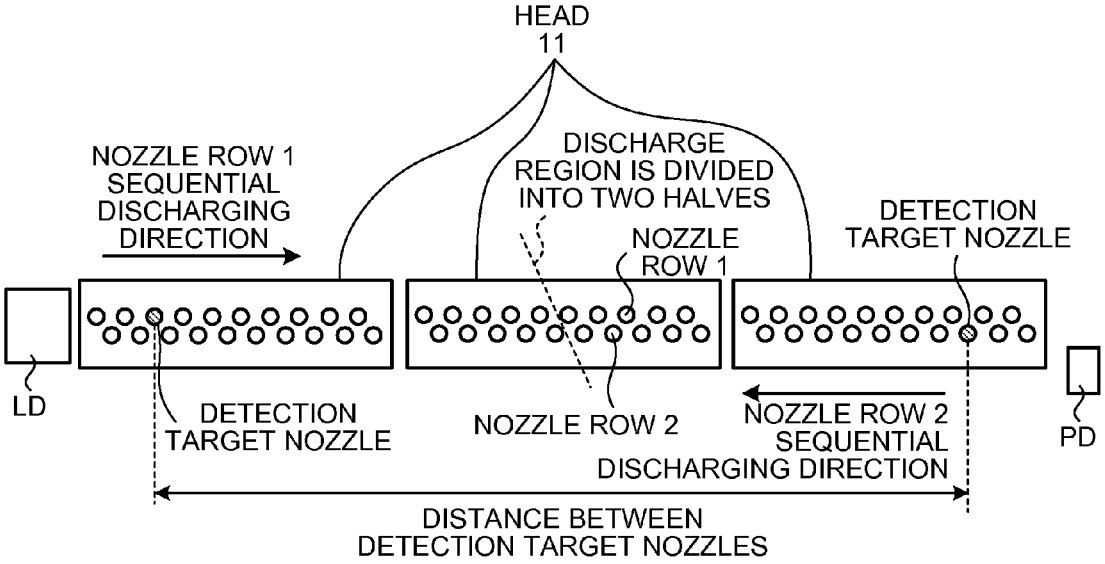
Figure 9:
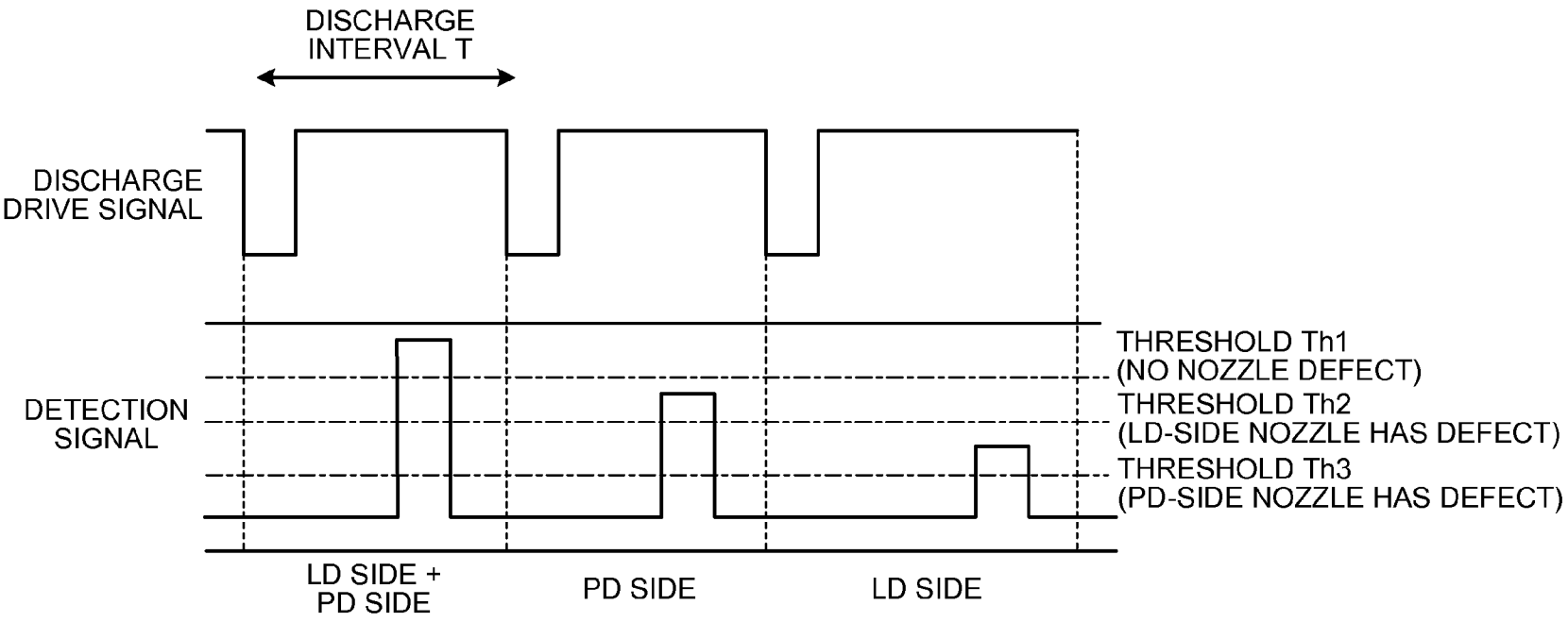
FIG. 9 is a diagram illustrating a detection signal of a PD when the distance between the detection target nozzles is long in the first embodiment.

FIGS. 8A and 8B are diagrams illustrating an ink droplet discharging state when a distance between the detection target nozzles is long. FIG. 9 is a diagram illustrating a detection signal of the PD in this case and illustrates the relation between the detection signal and a droplet discharge process controlled by a discharge drive signal and a discharge interval T. In the following explanation, the discharge region is divided into two halves at the center thereof, nozzles provided in the LD-side region are referred to as LD-side nozzles, and nozzles provided in the PD-side are referred to as PD-side nozzles.

A detection signal to be output varies depending on the amount of the scattered light received by the PD of the light-receiving unit 22. When there is a nozzle defect, the scattered light is not received and the detection signal is not output.

When the LD-side nozzle and the PD-side nozzle simultaneously discharge droplets, the level of the detection signal becomes high as illustrated in FIG. 9 because the light-receiving unit receives the scattered light that is scattered by simultaneous scattering of the laser light by the two discharged ink droplets.

The intensity of the laser light emitted by the LD of the light emitting unit 21 increases as the laser light travels farther from the LD side to the PD side; therefore, the intensity of the laser light irradiating an ink droplet varies. The variation in the intensity of the laser light causes variation in the level of a discharge detection signal between the LD-side nozzle and the PD-side nozzle. Specifically, the level of the detection signal of the PD-side nozzle becomes higher.

The level of the detection signal depends on the number of discharged droplets or the position of the discharge nozzle. Therefore, by setting three thresholds as illustrated in FIG. 9, it becomes possible to separately detect discharging states of the LD-side nozzle and the PD-side nozzle.

Figure 10A:
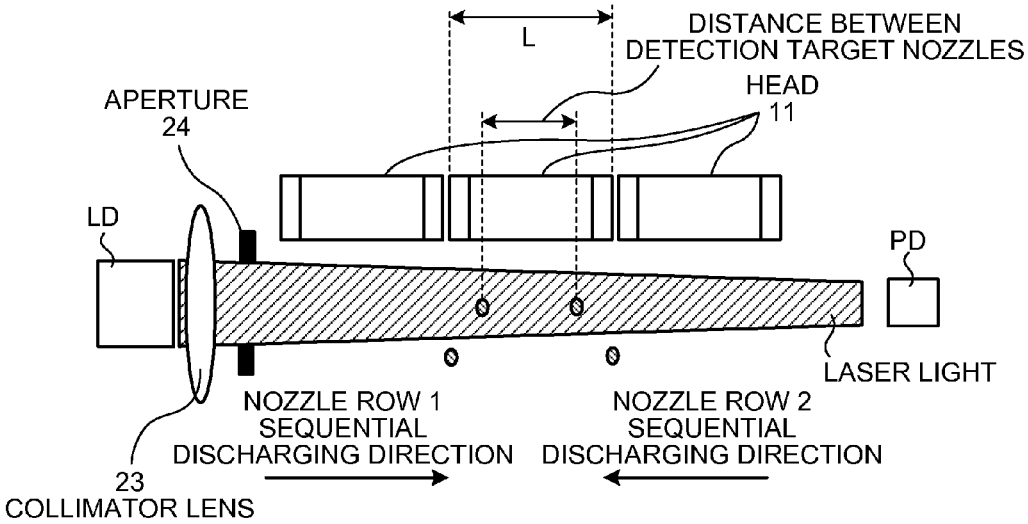
FIGS. 10A and 10B are diagrams illustrating an ink droplet discharging state when the distance between the detection target nozzles is short in the first embodiment.
Figure 10B:
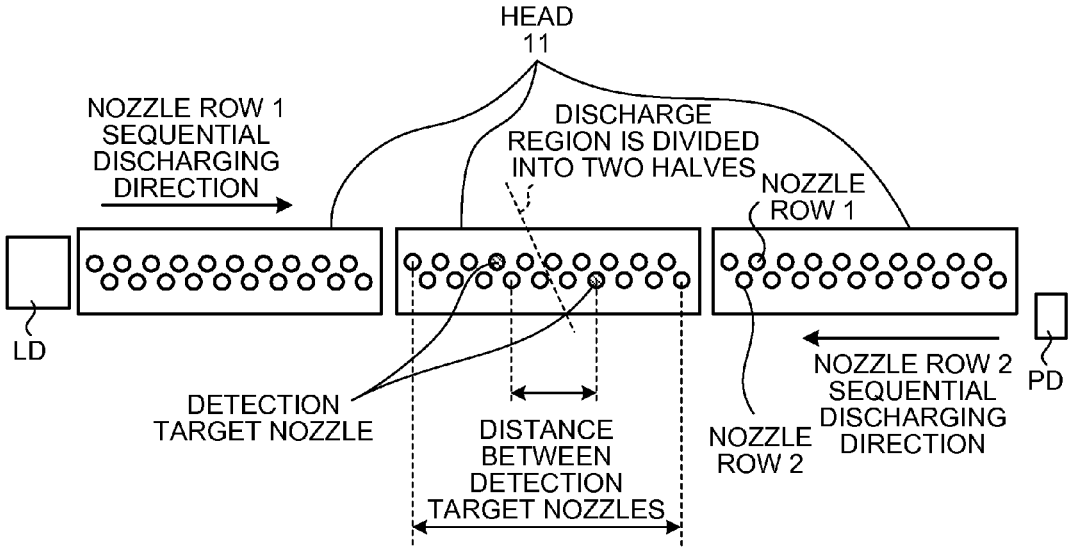
Figure 11:
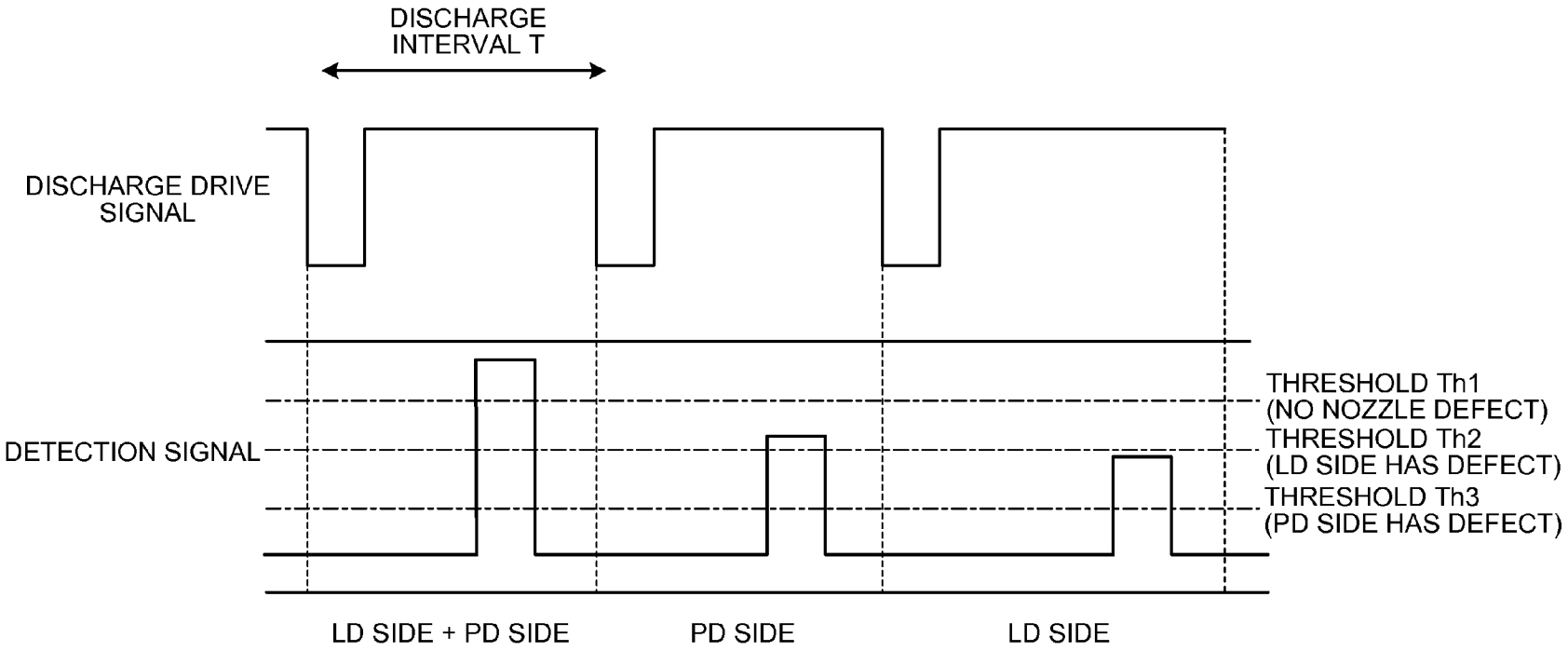
FIG. 11 is a diagram illustrating a detection signal of the PD when the distance between the detection target nozzles is short in the first embodiment.

FIGS. 10A and 10B are diagrams illustrating an ink droplet discharging state when the distance between the detection target nozzles is short. FIG. 11 is a diagram illustrating a detection signal of the PD in this case.

When the distance between the detection target nozzles becomes short, ink droplets are discharged at approximately the same positions on the laser light, so that almost no difference is found in the intensity of the laser light irradiating each of the ink droplets and a discharge detection signal output by each of the LD-side nozzle and the PD-side nozzle becomes at approximately the same level.

If the distance between the detection target nozzles changes, the detection signal output by each of the LD-side nozzle and the PD-side nozzle also changes. However, the level of the detection signal in the case that the LD-side nozzle and the PD-side nozzle simultaneously output ink droplets remains constant regardless of the change in the distance between the detection target nozzles.

When the distance between the detection target nozzles becomes short, a difference between discharge detection levels of the LD-side nozzle and the PD-side nozzle becomes smaller. Therefore, it becomes difficult to detect the discharging state of each of the nozzles by using a threshold unlike the case that the distance between the detection target nozzles is long. To cope with this situation, a detection-reference nozzle spacing L is set, and if the distance between the detection target nozzles becomes equal to or smaller than L, the droplet discharging state of each of the nozzles is detected by another processing to be described below. The length of the detection-reference nozzle spacing L is set depending on the degree of a change in the intensity of the laser light.

Figure 12:
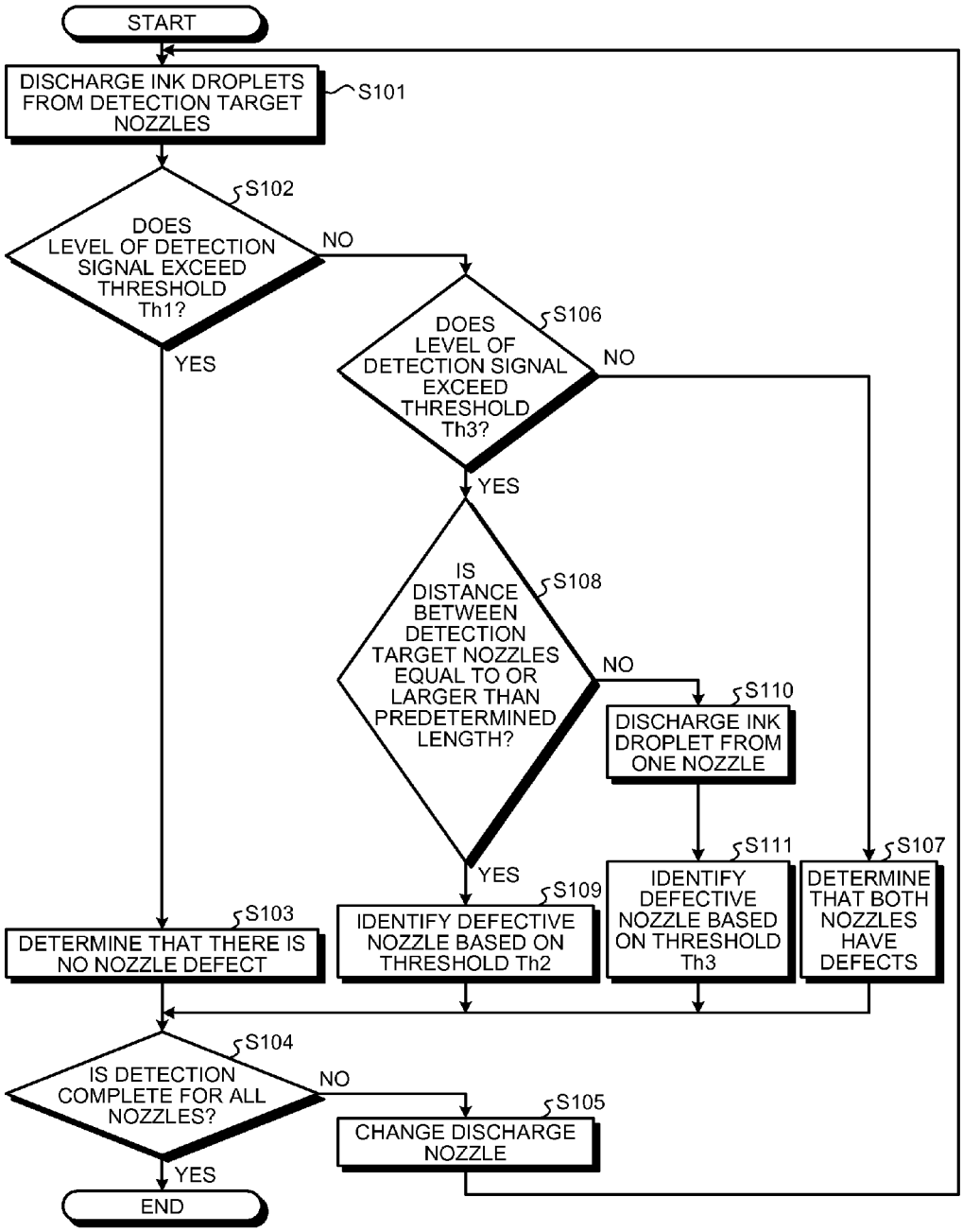
FIG. 12 is an operational flowchart according to the first embodiment.

A discharge detection operation performed by the inkjet recording device of the first embodiment will be described below with reference to FIG. 12. FIG. 12 is an operational flowchart of the discharge detection in the inkjet recording device of the present embodiment. The head control board 19 controls the discharge detection.

When the droplet discharge detection is started, nozzles that serve as the detection target nozzles are selected in order from the endmost nozzle on the LD side in the nozzle row 1 and in order from the endmost nozzle on the PD side in the nozzle row 2, and the detection target nozzles in the nozzle row 1 and the nozzle row 2 simultaneously discharge ink droplets (Step S101). In this case, a distance between the two detection target nozzles is equal to or larger than the detection-reference nozzle spacing L; therefore, it is possible to detect discharge of a droplet from each of the detection target nozzles based on a detection signal of the PD (that is, the detection signal varies depending on the droplet discharging states of the detection target nozzles).

When the ink droplets are discharged from the detection target nozzles, the laser light is scattered by the ink droplets and the PD receives the scattered light and outputs the detection signal. The detection signal is distinguished based on a threshold Th1. If the level of the detection signal exceeds the threshold Th1 (YES at Step S102), it is determined that there is no defect (no nozzle defect) through data processing (Step S103).

Until the droplet discharge detection is complete for all the nozzles (that is, until it is determined as YES rather than NO at Step S104), the detection target nozzles are changed at Step S105 and the process returns to Step S101 to repeat the series of operations. Changing the detection target nozzles is performed by selecting adjacent nozzles on the center side in the nozzle rows, respectively, as the detection target nozzles (the same is applied hereinafter in the present embodiment).

When the level of the detection signal does not exceed the threshold Th1, this indicates a case that one or both of the detection target nozzles have defects. Therefore, it is determined which case has occurred based on a threshold Th3. When the level of the detection signal exceeds the threshold Th3 (YES at Step S106), it is determined that one of the nozzles has a defect, and the process proceeds to Step S108 to perform a defective nozzle identification process. Conversely, when the level of the detection signal does not exceed the threshold Th3 (NO at Step S106), it is determined that the both of the nozzles have defects, and the series of operations is repeated by changing the detection target nozzle as described above.

At Step S108, it is determined whether the distance between the detection target nozzles is equal to or larger than L before identifying a defective nozzle. When the distance between the detection target nozzles is equal to or larger than a predetermined length (the detection-reference nozzle spacing L in this example) (YES at Step S108), there is a difference between the levels of the detection signals output by the LD-side nozzle and the PD-side nozzle. Therefore, it is possible to determine a detection signal that has firstly been output, based on a threshold Th2, and the defective nozzle is identified at Step S109. Specifically, when the level of the detection signal is higher than the threshold Th2, it is determined that the LD-side nozzle has a defect, and when the level of the detection signal is lower than the threshold Th2, it is determined that the PD-side nozzle has a defect. Subsequently, the series of the operations is repeated by changing the detection target nozzles as described above.

Conversely, when the distance between the detection target nozzles is smaller than L (NO at Step S108), almost no difference is found between the levels of the detection signals output by the LD-side nozzle and the PD-side nozzle. Therefore, one of the detection target nozzles is caused to re-discharge an ink droplet (Step S110). An output detection signal in this case can be determined based on the threshold Th3, and a defective nozzle is identified at Step S111. Specifically, when the level of the detection signal exceeds the threshold Th3, it is determined that a nozzle that has not re-discharged an ink droplet has a defect, and when the level of the detection signal does not exceed the threshold Th3, it is determined that a nozzle that has re-discharged an ink droplet has a defect. Subsequently, the series of operations is repeated by changing the detection target nozzles as described above.

The series of droplet discharge detection processes is repeated until the processes are completed for all the nozzles. When the detection processes are complete for all the nozzles, the droplet discharge detection operation ends.

Second Embodiment

A second embodiment of the droplet discharge detecting method will be described below with reference to FIGS. 13A to 18.

Figure 13A:
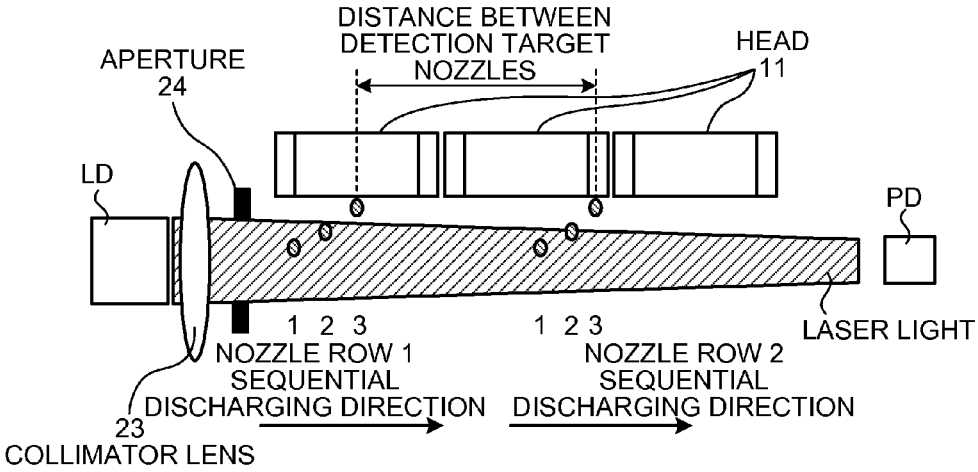
FIGS. 13A to 13C are diagrams illustrating a droplet discharging method and droplet discharge detection according to a second embodiment.
Figure 13B:
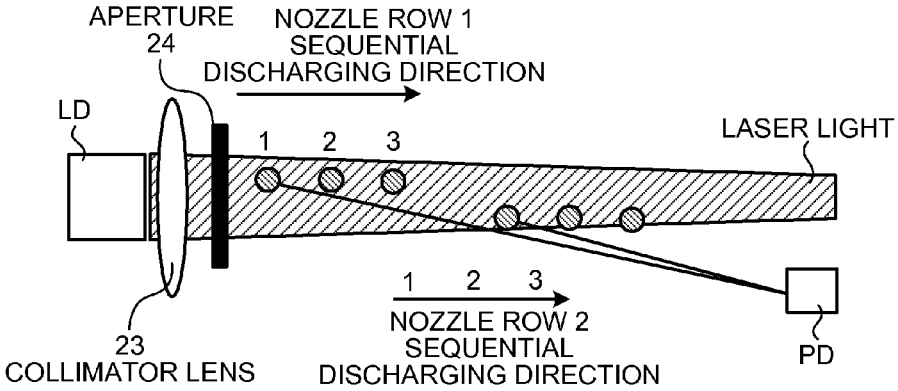
Figure 13C:
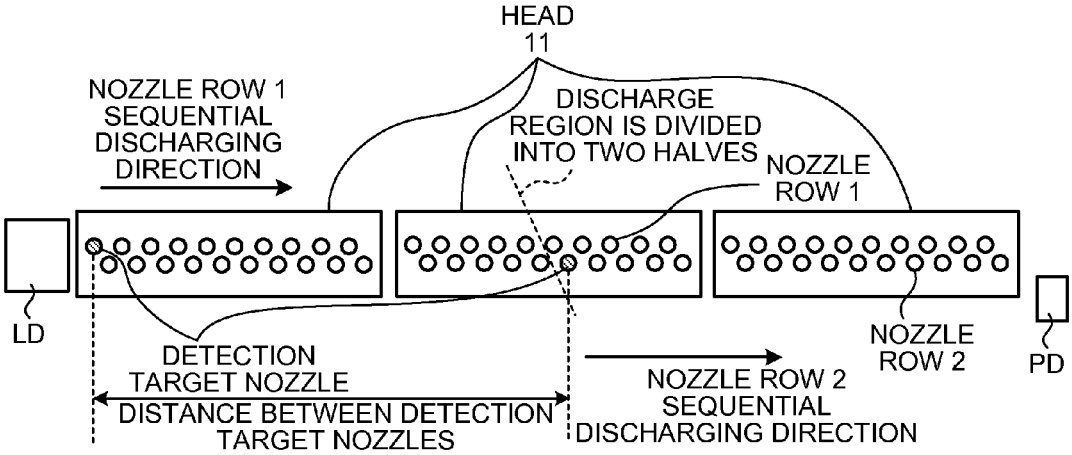

FIGS. 13A to 13C are diagrams illustrating a droplet discharging method and droplet discharge detection according to the second embodiment. As illustrated in FIGS. 13A and 13C, in the droplet discharge detection, ink droplets are discharged in order from the endmost nozzle on the LD side toward a nozzle at the center of the discharge region in the nozzle row 1 while ink droplets are discharged in order from a nozzle at the center of the discharge region toward the PD side in the nozzle row 2. The sequential discharge operations in the nozzle row 1 and the nozzle row 2 are performed synchronously; therefore, two nozzles simultaneously discharge ink droplets. Once the sequential discharge operations end, the nozzle row 1 and the nozzle row 2 are interchanged with each other and sequential discharging of droplets is performed from all the nozzles in the discharge region, thereby to complete the droplet discharge detection.

The droplets are sequentially discharged in the nozzle row 1 and the nozzle row 2 synchronously as described above; therefore, a distance between the detection target nozzles remains constant. Furthermore, the distance between the detection target nozzles can be set to be sufficiently larger than the detection-reference nozzle spacing L described in the first embodiment. Therefore, in the present embodiment, it is not needed to re-discharge an ink droplet from one of the target detection nozzles to detect discharge again unlike the case that the distance between the detection target nozzles is smaller than the detection-reference nozzle spacing L in the first embodiment.

FIGS. 14A, 14B, 16A, and 16B are diagrams illustrating ink droplet discharging states in the second embodiment. FIGS. 15 and 17 are diagrams illustrating a detection signal of the PD when droplets are discharged from a pair of the detection target nozzles. Specifically, FIG. 15 illustrates the detection signal that is output when the detection target nozzles are the endmost nozzle on the LD-side and the center nozzle (see FIGS. 14A and 14B), and FIG. 17 illustrates the detection signal that is output when the detection target nozzles are the center nozzle and the endmost nozzle on the PD-side (see FIGS. 16A and 16B).

Figure 14A:
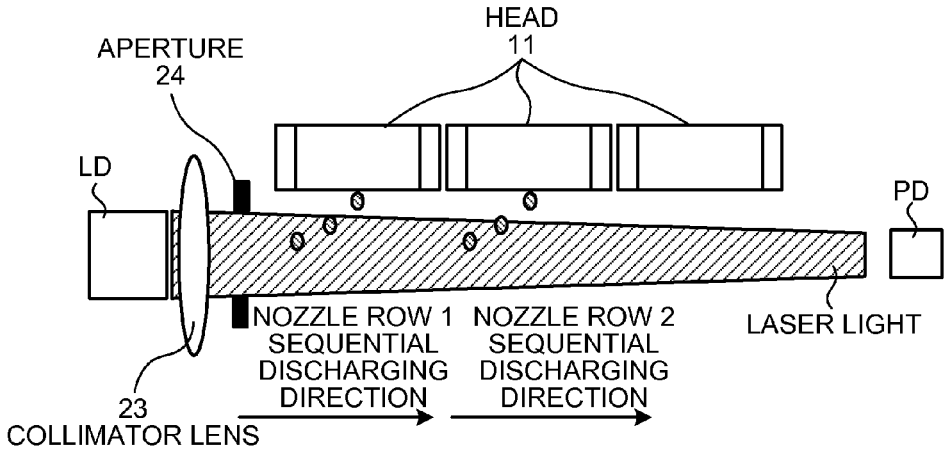
FIGS. 14A and 14B are diagrams illustrating an ink droplet discharging state in the second embodiment.
Figure 14B:
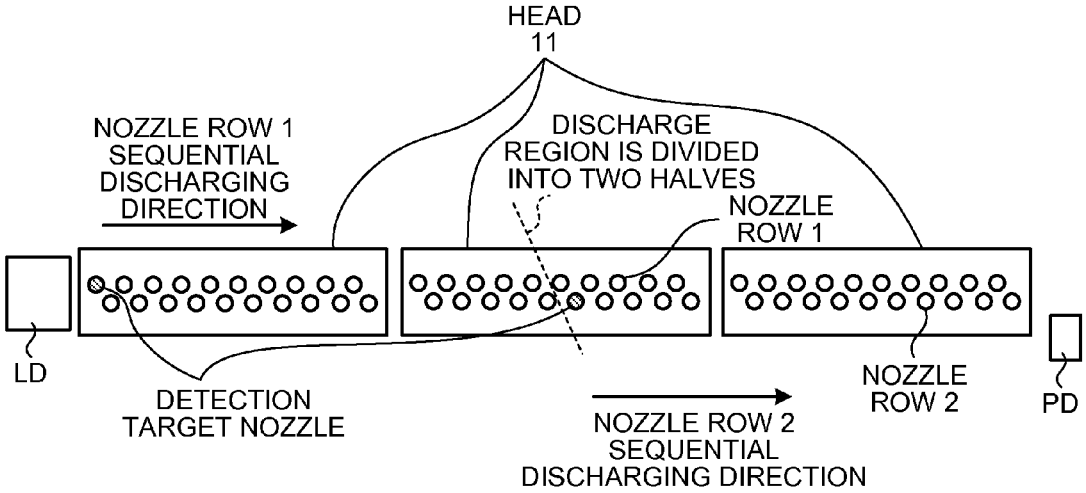
Figure 15:
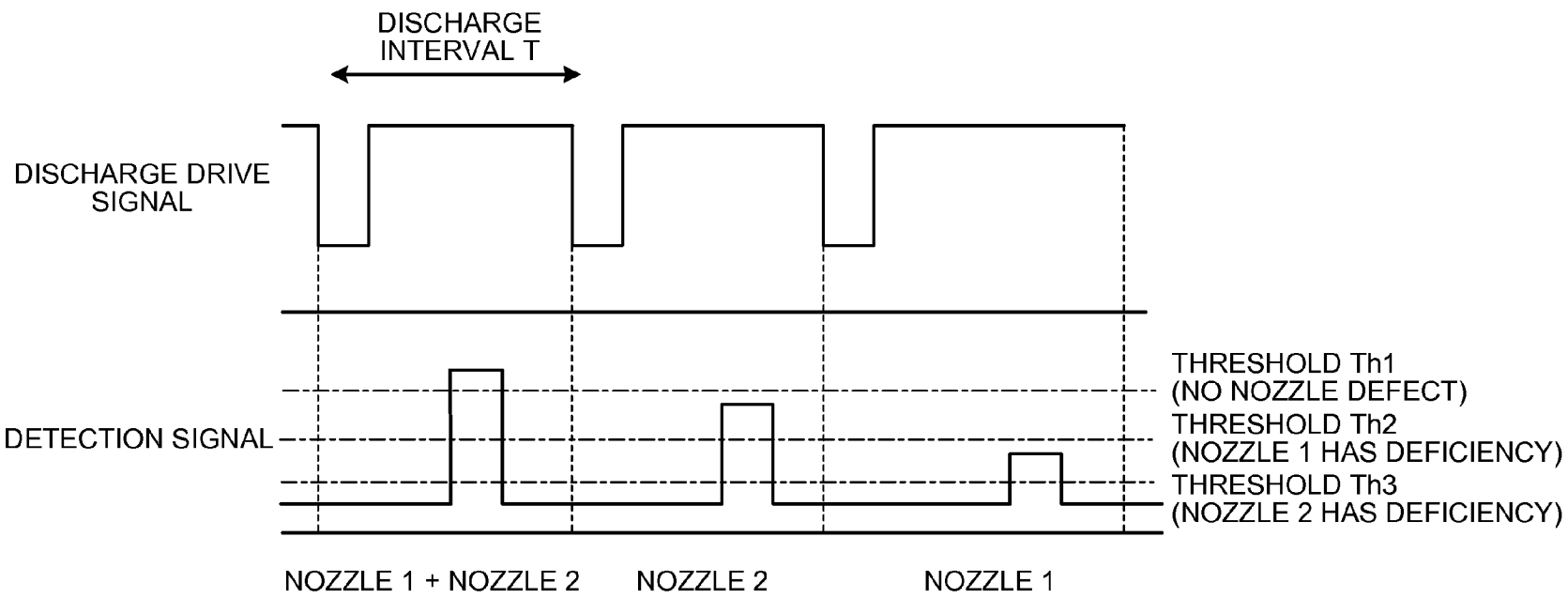
FIG. 15 is a diagram illustrating a detection signal of the PD when droplets are discharged from a pair of detection target nozzles in the second embodiment.
Figure 16A:
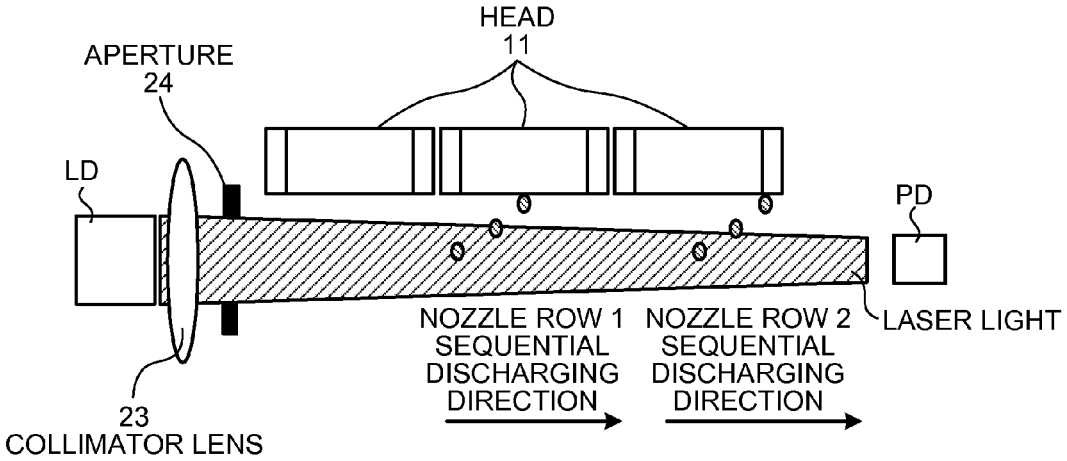
FIGS. 16A and 16B are diagrams illustrating an ink droplet discharging state in the second embodiment.
Figure 16B:
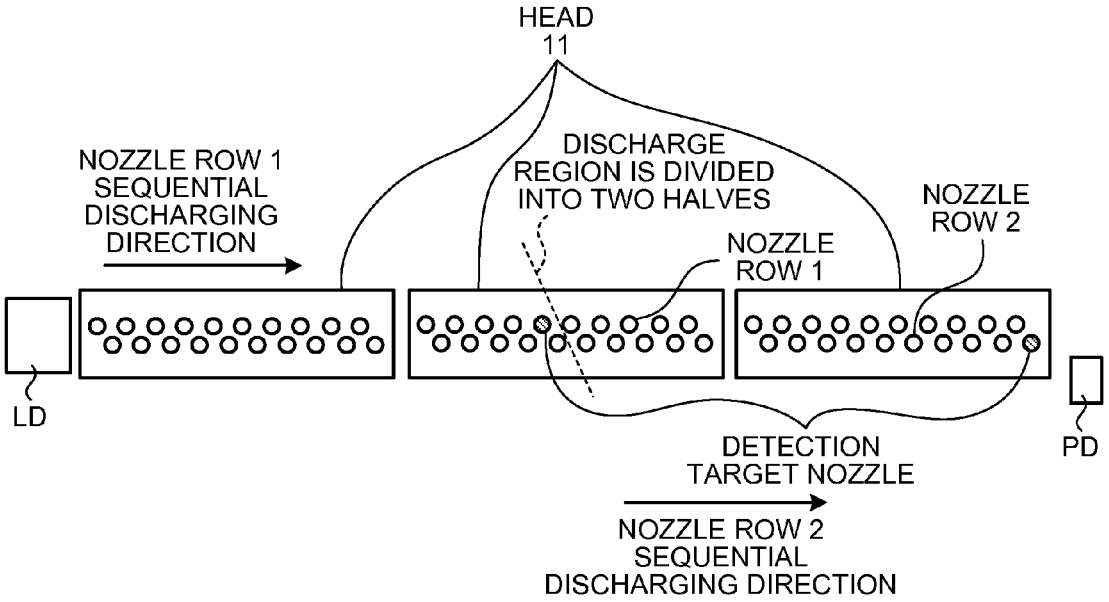
Figure 17:
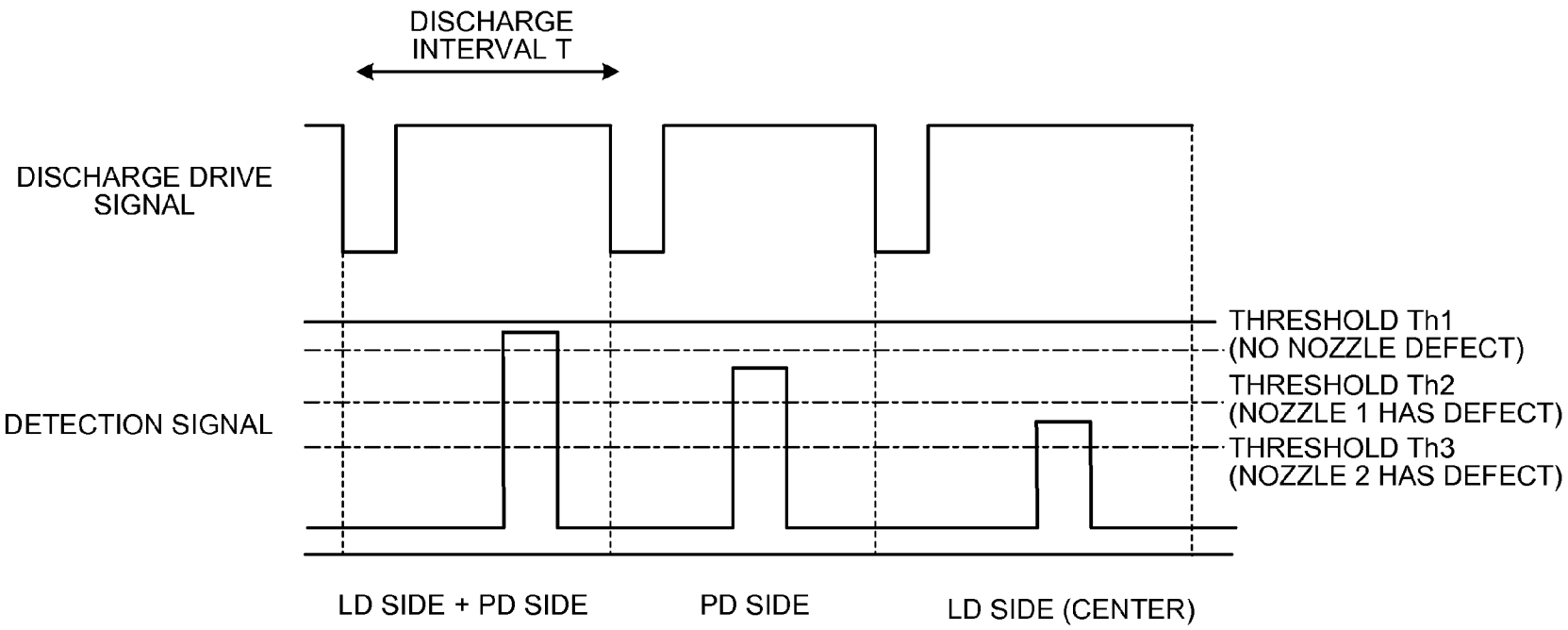
FIG. 17 is a diagram illustrating a detection signal of the PD when droplets are discharged from a pair of detection target nozzles in the second embodiment.

The positions of the detection target nozzles are different between a droplet discharging state illustrated in FIGS. 14A and 14B and a droplet discharging state illustrated in FIGS. 16A and 16B. The intensity of the laser light that irradiates an ink droplet varies depending on the position of a discharge nozzle as described above; therefore, the level of the detection signal to be output also varies. The intensity of the laser light increases as the light approaches the PD side; therefore, the voltage level of the detection signal becomes higher in the droplet discharging state illustrated in FIGS. 16A and 16B, in which the detection target nozzles are in the PD-side region, than in the droplet discharging state illustrated in FIGS. 14A and 14B.

In the droplet discharge detecting method according to the second embodiment, three thresholds (Th1, Th2, and Th3) as illustrated in FIGS. 15 and 17 are set by taking the advantage of the fact that the distance between the detection target nozzles is always constant and larger than the detection-reference nozzle spacing L, so that the levels of the detection signals output by the LD-side nozzle and the PD-size nozzles become always different from each other; therefore, it is possible to detect the droplet discharging state of each of the nozzles based on the thresholds and the levels of the detection signals.

As can be seen by comparison between the detection signals illustrated in FIG. 15 and FIG. 17, the level of the detection signal varies depending on the positions of the detection target nozzles. Therefore, the thresholds are changed depending on the positions of the detection target nozzles. Specifically, because the level of the detection signal increases as the detection target nozzles approach the PD side, the levels of the thresholds are also increased as the detection target nozzles approach the PD. Therefore, the levels of the thresholds illustrated in FIG. 17 are higher than the levels of the thresholds illustrated in FIG. 15. To change the thresholds as above, it is preferable to preset a threshold for each position of a nozzle and to use the threshold corresponding to the position of the detection target nozzle when the threshold is compared with the detection signal.

Figure 18:
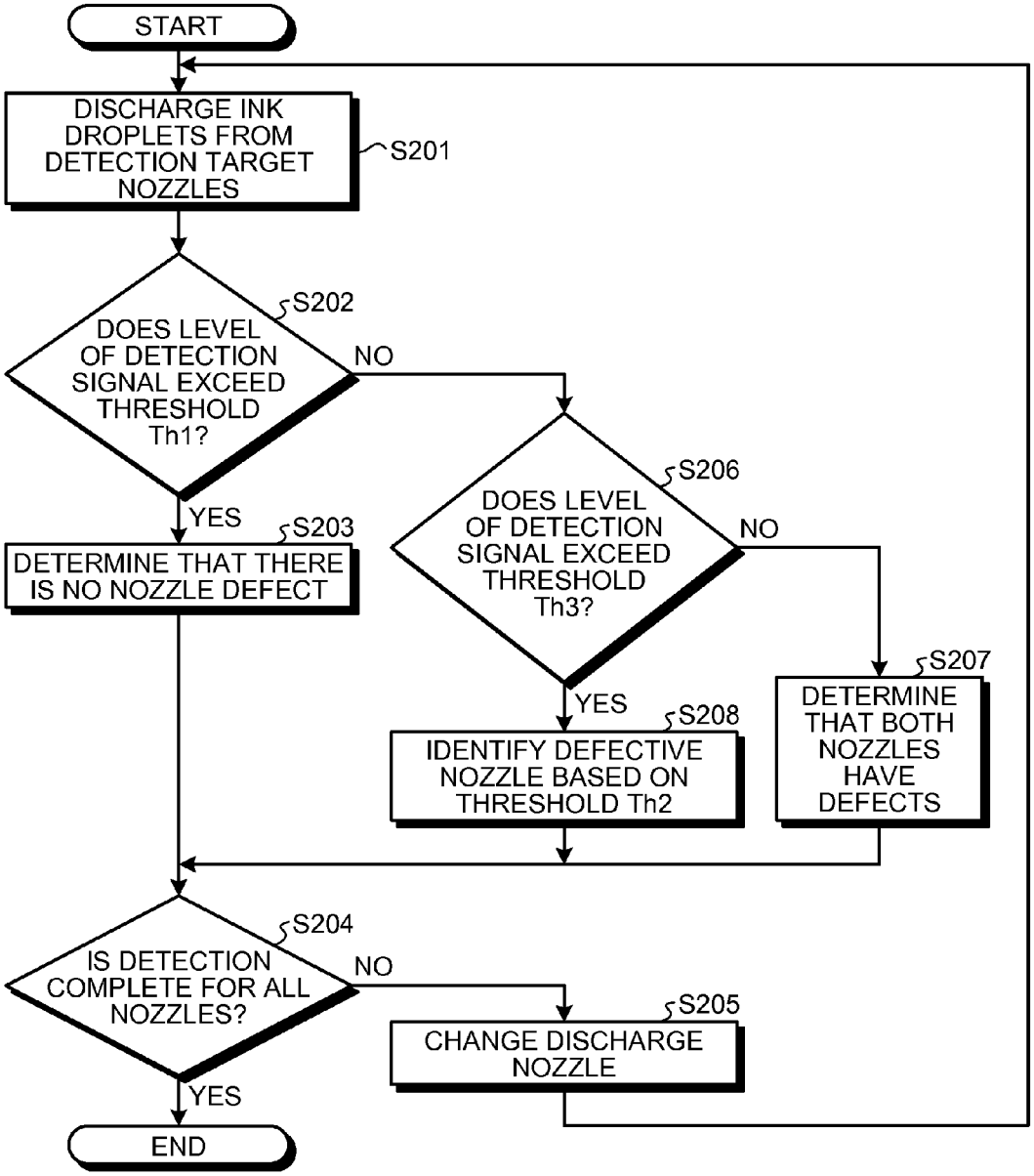
FIG. 18 is an operational flowchart according to the second embodiment.

A discharge detection operation performed by the inkjet recording device of the second embodiment will be described below with reference to FIG. 18. FIG. 18 is an operational flowchart of discharge detection in the inkjet recording device of the second embodiment. The head control board 19 controls the discharge detection.

Basic operations in the second embodiment are the same as those described in the first embodiment; therefore, the explanation of the same processes is not repeated. In the second embodiment, when the droplet discharge detection is started at Step S201 of the second embodiment, which corresponds to Step S101 of the first embodiment, nozzles that serve as the detection target nozzles are selected in order from the endmost nozzle on the LD-side in the nozzle row 1 and in order from the endmost nozzle on the center side of the PD-side region, which is a half region of the nozzle row (the discharge region is divided into two halves), in the nozzle row 2. Accordingly, the detection target nozzles in the nozzle row 1 and the nozzle row 2 simultaneously discharge ink droplets. In this case, a distance between the two detection target nozzles is equal to or larger than the detection-reference nozzle spacing L; therefore, it is possible to detect discharge of a droplet from each of the detection target nozzles based on the detection signal of the PD (that is, the detection signal varies depending on the droplet discharging states of the detection target nozzles). When the discharge nozzle is changed in the subsequent process, adjacent nozzles on the PD-side are selected as the detection target nozzles. Therefore, the distance between the detection target nozzles remains constant (remains equal to or larger than the detection-reference nozzle spacing L). Consequently, it becomes possible to omit the process for determining whether the distance between the detection target nozzles is equal to or larger than the detection-reference nozzle spacing L (Step S108) and the processes that are required when the distance between the detection target nozzles is smaller than the detection-reference nozzle spacing L (Steps S109 and S110). As a result, it is not needed to re-discharge an ink droplet from the detection target nozzle to identify a defective nozzle. Although not illustrated in FIG. 18, the three thresholds are changed depending on the positions of the detection target nozzles as described above.

The inkjet recording device 10 and the method for detecting discharge of an ink droplet according to the present embodiment have been described in detail. In the present embodiment, when detecting an ink droplet discharged from the head 11 that includes two nozzle rows provided in parallel therein, two adjacent nozzles are caused to discharge ink droplets simultaneously, and a nozzle defect is detected based on the voltage level of a detected waveform. Even with the same number of nozzles, a nozzle defect is detectable in two nozzles that discharge droplets simultaneously, and therefore, a time period needed for discharge detection is halved compared with the conventional case where a single nozzle is caused to discharge an ink droplet at a time. Furthermore, deviation of the center of the optical axis of the laser light from the middle between the nozzle rows enables determination on which one of the ODD row and the EVEN row includes a nozzle defect.

Meanwhile, a control program or another computer program for executing the discharge detection in the image forming apparatus of the present embodiment may be incorporated in advance by being provided on a NV-RAM, ROM, or other nonvolatile storage media equipped with the image forming apparatus, or may be written on a CD-ROM, flexible disk (FD), CD-R, digital versatile disk (DVD) or other computer-readable recording media in the format of an installable or executable file.

The above-mentioned programs may be stored on a computer connected to a network such as the Internet to be provided or distributed through downloading via the network.

According to the embodiments, the droplet discharging state is detected based on the scattered light scattered by irradiation of droplets that are simultaneously discharged from a plurality of detection target nozzles. Therefore, it is possible to shorten a time taken to detect a defective nozzle. Furthermore, the diameter of laser light is decreased or increased with an increase in a traveling distance of the laser light from the light emitting unit in the droplet discharge region such that the focal point of the laser light is positioned outside the discharge region. Therefore, a difference is found in the intensity of the scattered light caused by droplets discharged from detection target nozzles located at different distances from the light emitting unit. Consequently, it is possible to detect which nozzle has a defect.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a droplet discharging head that includes a plurality of nozzles;

a light emitting unit configured to irradiate laser light emitted from a light-emitting element in a direction intersecting a discharging direction of a droplet discharged from each of the nozzles of the droplet discharging head;

a light-receiving unit that is deviated from an optical axis of the light emitting unit such that the light-receiving unit is configured to receive scattered light the light-receiving unit being configured to outputs a detection signal corresponding to an amount of the scattered light, the scattered light being light that is scattered by the discharged droplet as a result of the discharged droplet being irradiated by the laser light; and a droplet discharge detecting unit configured to detect a droplet discharging state of each of the nozzles based on the detection signal output from the light-receiving unit, wherein the light emitting unit is configured to emit the laser light such that intensity of the laser light increases or decreases as the laser light travels farther from the light emitting unit, and the droplet discharge detecting unit is configured to select as detection target nozzles, from the droplet discharging head, a plurality of nozzles located at different distances from the light emitting unit so as to cause a variation in the detection signal depending on a droplet discharging state, and configured to detect the droplet discharging state of each of the detection target nozzles based on the scattered light scattered by irradiation of droplets that are simultaneously discharged from the detection target nozzles.

2. The image forming apparatus according to claim 1, wherein the droplet discharging head includes a plurality of nozzle rows, and one of the detection target nozzles is selected from each of the nozzle rows, respectively.

3. The image forming apparatus according to claim 1, wherein the laser light is emitted by the light emitting unit through a lens and an aperture and is focused on a region outside a discharge region, and the diameter of the laser light decreases or increases as the laser light approaches a light-receiving unit side.

4. The image forming apparatus according to claim 1, wherein the droplet discharge detecting unit determines whether a droplet is discharged from each of the detection target nozzles based on the detection signal and a plurality of preset thresholds.

5. The image forming apparatus according to claim 1, wherein the droplet discharge detecting unit causes one of the detection target nozzles to re-discharge a droplet to detect a droplet discharging state of the one of the detection target nozzles when a spacing between the detection target nozzles becomes smaller than a predetermined spacing.

6. The image forming apparatus according to claim 1, wherein the droplet discharge detecting unit changes levels of the thresholds depending on positions of the detection target nozzles.

7. A droplet discharge detecting method implemented in an image forming apparatus, the image forming apparatus including a droplet discharging head that includes a plurality of nozzles, a light emitting unit that irradiates laser light emitted from a light-emitting element in a direction intersecting a discharging direction of a droplet discharged from each of the nozzles of the droplet discharging head, a light-receiving unit that is deviated from an optical axis of the light emitting unit such that the light-receiving unit receives scattered light, and outputs a detection signal corresponding to an amount of the scattered light, the scattered light being light that is scattered by the discharged droplet as a result of the discharged droplet being irradiated by the laser light, and a droplet discharge detecting unit that detects a droplet discharging state of each of the nozzles based on the detection signal output from the light-receiving unit, the method comprising:

emitting, by the light emitting unit, the laser light such that intensity of the laser light increases or decreases as the laser light travels farther from the light-emitting section;

selecting as detection target nozzles, by the droplet discharge detecting unit, from the droplet discharging head, a plurality of nozzles located at different distances from the light emitting unit so as to cause a variation in the detection signal depending on the droplet discharging state; and detecting, by the droplet discharge detecting unit, the droplet discharging state of each of the detection target nozzles based on the scattered light scattered by irradiation of droplets that are simultaneously discharged from the detection target nozzles.

8. The droplet discharge detecting method in the image forming apparatus according to claim 7, wherein the droplet discharging head includes a plurality of nozzle rows, and one of the detection target nozzles is selected from each of the nozzle rows, respectively.

9. The droplet discharge detecting method in the image forming apparatus according to claim 7, wherein the laser light is emitted by the light emitting unit through a lens and an aperture and is focused on a region outside a discharge region, and the diameter of the laser light decreases or increases as the laser light approaches a light-receiving unit side.

10. The droplet discharge detecting method in the image forming apparatus according to claim 7, further comprising:

determining, by the droplet discharge detecting unit, whether a droplet is discharged from each of the detection target nozzles based on the detection signal and a plurality of preset thresholds.

11. The droplet discharge detecting method in the image forming apparatus according to claim 7, further comprising:

causing, by the droplet discharge detecting unit, one of the detection target nozzles to re-discharge a droplet to detect a droplet discharging state of the one of the detection target nozzles when a spacing between the detection target nozzles becomes smaller than a predetermined spacing.

12. The droplet discharge detecting method in the image forming apparatus according to claim 7, further comprising:

changing, by the droplet discharge detecting unit, levels of the thresholds depending on positions of the detection target nozzles.

13. A computer program product comprising a non-transitory computer-usable medium having a computer-readable program code embodied in the medium causing a computer to instruct an image forming apparatus that includes, a droplet discharging head that includes a plurality of nozzles;

a light emitting unit that irradiates laser light emitted from a light-emitting element in a direction intersecting a discharging direction of a droplet discharged from each of the nozzles of the droplet discharging head;

a light-receiving unit that is deviated from an optical axis of the light emitting unit such that the light-receiving unit receives scattered light, and outputs a detection signal corresponding to an amount of the scattered light, the scattered light being light that is scattered by the discharged droplet as a result of the discharged droplet being irradiated by the laser light; and a droplet discharge detecting unit that detects a droplet discharging state of each of the nozzles based on the detection signal output from the light-receiving unit to function as:

the light emitting unit that emits the laser light such that intensity of the laser light increases or decreases as the laser light travels farther from the light emitting unit, and the droplet discharge detecting unit that selects as the detection target nozzles, from the droplet discharging head, a plurality of nozzles located at different distances from the light emitting unit so as to cause a variation in the detection signal depending on a droplet discharging state, and that detects the droplet discharging state of each of the detection target nozzles based on the scattered light scattered by irradiation of droplets that are simultaneously discharged from the detection target nozzles.

* * * * *